US006675866B2

(12) United States Patent
Amano et al.

(10) Patent No.: US 6,675,866 B2
(45) Date of Patent: Jan. 13, 2004

(54) SYSTEM FOR MONITORING MOLDING MACHINE AND HYDROSTATIC MOLDING MACHINE

(75) Inventors: Hironobu Amano, Toyokawa (JP); Yasuo Moribe, Toyokawa (JP); Hiroshi Umeda, Toyokawa (JP); Mitsuyuki Matsushita, Toyokawa (JP)

(73) Assignee: Sintokogio Ltd., Aichi-ken (JP)

( * ) Notice: Subject to any disclaimer, the term of this patent is extended or adjusted under 35 U.S.C. 154(b) by 195 days.

(21) Appl. No.: 10/009,642

(22) PCT Filed: Apr. 11, 2001

(86) PCT No.: PCT/JP01/03129

§ 371 (c)(1),
(2), (4) Date: Dec. 12, 2001

(87) PCT Pub. No.: WO01/76791

PCT Pub. Date: Oct. 18, 2001

(65) Prior Publication Data

US 2002/0157802 A1 Oct. 31, 2002

(30) Foreign Application Priority Data

Apr. 12, 2000 (JP) ..... 2000-110088
Mar. 15, 2001 (JP) ..... 2001-073670

(51) Int. Cl.[7] ..... B22D 17/32

(52) U.S. Cl. ..... 164/154.1; 164/154.8; 164/195

(58) Field of Search ..... 164/154.1, 154.8, 164/195, 37, 38, 4.1, 456

(56) References Cited

U.S. PATENT DOCUMENTS 5,695,000 A * 12/1997 Uzaki et al. ..... 164/194
5,697,424 A * 12/1997 Ferdinandsen et al. ..... 164/456
5,947,185 A * 9/1999 Oda et al. ..... 164/456

FOREIGN PATENT DOCUMENTS

JP 03-226352 10/1991
JP 05-237597 9/1993
WO WO 97/46342 12/1997

* cited by examiner

*Primary Examiner*—M. Alexandra Elve
*Assistant Examiner*—I.-H. Lin
(74) *Attorney, Agent, or Firm*—Finnegan, Henderson, Farabow, Garrett & Dunner LLP

(57) ABSTRACT

To provide a monitoring system for remotely monitoring the operation of a molding apparatus or an air-flow and press molding apparatus. The monitoring systems for monitoring a molding apparatus and an air-flow and press molding apparatus include sensors, a local unit, and a remote unit. The local unit transmits the signals associated with the required attributes, which are measured by the sensors, of the molding apparatus to the remote unit via the communication network. The remote unit is designed so that it receives the signals transmitted from the local unit; thereby the user can monitor the molding apparatus or the air-flow and press molding apparatus remotely at the production and operation by them.

12 Claims, 4 Drawing Sheets

SYSTEM FOR MONITORING MOLDING MACHINE AND HYDROSTATIC MOLDING MACHINE

CROSS-REFERENCE TO RELATED APPLICATION

This application is A 371 of PCT/SP01/03189 filed on Apr. 11, 2001.

FIELD OF INVENTION

The present invention relates to monitoring systems for a molding and an air-flow and press molding apparatus, in which information on the molding can be received and transmitted via a communication network to a remote location.

BACKGROUND OF THE INVENTION

The air-flow and press molding apparatus used in foundries which, for example, after filling molding sand in a molding frame, pressurizes the molding sand by means of air pressure and further compresses it mechanically is known.

At present, the use of a molding apparatus such as an air-flow and press molding apparatus in foundries leads to labor-saving and a reduction in manpower, through management based on the use of various types of sensors. Therefore, there is interest in knowing how the molding apparatus that is used to make molds is actually operated in such labor-saving equipment.

However, in the conventional molding apparatus, the data associated with the long-term operation cannot be stored because it is built in the molding apparatus itself or the capacity of the memory device attached to it is not large. Also, a user cannot know enough on how the molding apparatus is operated on a daily basis because the user cannot utilize such data.

For the reasons mentioned above, in the molding apparatus such a conventional air-flow and press molding apparatus, a production management system, which is operated separately from the molding apparatus, was used to manage the production of the molds of which orders were received instead of monitoring the condition of operation of the molding apparatus itself, etc.

However, in the management of operations by means of this production management system, because a user cannot get information on how to mold by means of the molding apparatus on a daily basis, the user may wish to manage the quality of the molding, do maintenance on equipment, or deal with trouble-shooting for the molding apparatus by getting the information, transmitting it to a remote location, and providing it there.

There is also the need to conduct the management of operations of the molding apparatus by indicating the information on the number of reserved moldings and the remaining number of moldings on-site or transmitting this information to a remote location and providing it and monitoring the indication.

Further, because the data on the operation on a daily basis has not been accumulated, the user cannot obtain adequate information on the regular or preventive maintenance of the molding apparatus. As a result, the efficiency of the operation may in fact worsen because of, for example, excessive repairs or maintenance, or producing until the production line must be stopped due to a breakdown.

Therefore, users of the molding apparatus in foundries need information on its operation.

SUMMARY OF THE INVENTION

The present invention is devised to solve the above problem. One object of the invention is to provide a monitoring system for a molding apparatus that at least monitors the molding apparatus at the stage of the production and transmits the information on the molding to a remote location.

To achieve the above objective, a monitoring system for a molding apparatus according to the present invention comprises: sensors for measuring required attributes associated with the molding apparatus; a local unit for transmitting signals that correspond to the required attributes measured with said sensors over a network; and a remote unit connected to said communication network for receiving the signals that correspond to the required attributes from said local unit, indicating the required attributes associated with the molding apparatus, and at least monitoring the molding apparatus at the stage of the operation of the molding apparatus.

According to the present invention, data collected from the molding apparatus at the time of production can be transmitted to a remote location to be analyzed as information on molding. The number of products (e.g., the number of moldings per day, the number of reserved moldings, the remaining number of moldings, and the achievement ratio) and the data on molding (e.g., molding pressure, air pressure, sand temperature, and pattern temperature) can be selectively indicated based on the analysis results.

In the present invention the molding apparatus includes a mold molding apparatus to mold a mold, a molding apparatus to mold cores, etc., used at a foundry.

The required attributes that correspond to the molding apparatus in the present invention include the number of products (e.g., the number of moldings per day, the number of reserved moldings, the remaining number of moldings, and the achievement ratio) and the data on molding (e.g., molding pressure, air pressure, sand temperature, and pattern temperature). Examples of the sensors in the present invention include a pressure sensor, a temperature sensor, an ammeter, a stroke counter, a load sensor, a counter, a limit switch, and other types of sensors which can measure the attributes of the molding.

The local unit in the present invention is one that is incorporated in a control device of the molding apparatus and is positioned adjacent to the molding apparatus. It incorporates the function by which the software of the local unit can be re-set by a user command from a remote location via a communication network. Namely, the user at the remote location can change the measurement standards and re-set the local unit to change specific limitations or programmed variables. For example, to determine whether or not the measurement standards are right, a means composed of the software and a comparator connected to a processor can be used, and the variables can be changed if they are outside the predetermined scope.

Further, according to the present invention, a plurality of standards for monitoring are incorporated in the local unit and the user can select them by means of different input and output cards. The input and output cards are connected to a sensor box, and the sensor box is attached to a specific part of the molding apparatus. These input and output cards process the signals from the sensors and generate signals that are received as input to the local unit.

The communication network is utilized between the local unit and the remote unit. Such a communication system can contain other protocols for receiving and transmitting data to the remote location, such as telephone wires and Internet access. More simply, a serial cable may connect the worksite and the remote location. Alternatively, to transmit the data between the two sites, other protocols that are well-known in this technical field, for example, LAN (Local Area Network) and WAN (Wide Area Network), are available.

A modem that is functionally connected to the local unit can be used as the means for accessing the communication network.

In the present invention, "at least at the stage of operation of the molding apparatus" means that it is possible to use it in response to the user command even at times other than when in operation. For example, it could be used to monitor a log only when there is a warning in the specific required period, or to recompose the log of the data in response to the parameters.

"Monitoring the molding apparatus" means that the monitoring system for the molding apparatus outputs the signals to a maintenance worker of the molding apparatus at the worksite via a facsimile machine, a cellular phone, or other mobile communication means, for example. Hereby, the need for maintenance can be transmitted to the worker as quickly as possible.

The remote unit is connected to the local unit via the communication network, and is adjusted to receive the signals from the local unit. Also, the remote unit is adjusted to indicate the measured attributes of the molding apparatus; thereby the operating condition of the molding apparatus can be monitored at the remote location at the stage of production by the molding apparatus. In the same way as for the local unit, to determine whether or not the measurement standards are right a function for analyzing the measured signal may be provided.

Thus the means for accessing the communication network connected to the local unit is provided in the present invention. The sensors to measure the required value of the molding apparatus are connected to the local unit; thereby the signals can be transmitted to it. The local unit is adjusted to transmit the signals via the communication network in response to the measured attributes.

In view of the above problem, another object of the present invention is to provide a monitoring system for an air-flow and press molding apparatus that monitors it at least at the stage of production and transmits the information on molding to a remote location.

To achieve the above object, a monitoring system for an air-flow and press molding apparatus according to the present invention is characterized by comprising: sensors for measuring required attributes associated with the air-flow and press molding apparatus; a local unit for transmitting signals that correspond to the required attributes measured with said sensor over a network; and a remote unit connected to said communication network for receiving the signals transmitted from the local unit, indicating the required attributes associated with the air-flow and press molding apparatus, and monitoring the molding apparatus at least at the stage of operation of the air-flow and press molding apparatus.

According to the present invention, data collected from the air-flow and press molding apparatus at the time of production can be transmitted to the remote location to analyze it. This data includes the attributes associated with the air-flow pressure of the air-flow and press molding apparatus, for example, the forms of the patterns to be molded, the air pressure, the period of the air-flow pressure, the air pressure in the air-flow pressure tank, and the air pressure in the air-flow pressure head are measured, and any abnormality in the air-flow pressure tank can be indicated based on the analysis results. Next are the attributes associated with the squeeze of the air-flow and press molding apparatus. For example, the squeeze pressure, the height of the mold, the features of the molding sand, and the changes of the patterns are measured, and the proper conditions of the squeeze can be ordered based on the analysis results. Further, a method for spraying the mold parting agent of the air-flow and press molding apparatus, measured sound data of the air-flow pressure valve, and data of the sand temperature can be selectively indicated.

The air-flow and press molding apparatus according to the present invention includes the molding apparatus that molds by making the inside of the mold into a vacuum from the side of the pattern plate.

The sensors for measuring used in the present invention include the following. To measure the attributes associated with the air-flow pressure of the air-flow and press molding apparatus; pressure sensors are used for the air pressure, air pressure in the air-flow pressure tank, and air pressure in the air-flow pressure head. A timer is used for an air-flow pressure time. A sensor for measuring heights or an infrared-ray distance meter is used for measuring the forms of the pattern to be molded.

To measure the attributes associated with the squeeze of the air-flow and press molding apparatus, for example, a pressure gauge for squeeze pressure, an encoder for the height of the mold, an encoder, a moisture meter and a temperature sensor for the features of the molding sand, and an image sensor for the changes of the pattern are used. These sensors for measurements measure the attributes of the mold in conjunction with limit switches, proximity switches, ammeters, a stroke counter, a molding counter, a noise meter or a sensor for measuring noise, and a load cell.

The local unit in the present invention is incorporated in a control device of the air-flow and press molding apparatus and is positioned adjacent to the air-flow and press molding apparatus. It incorporates the function by which software of the local unit can be re-set by a user command from the remote location via a communication network. Namely, the user can change measurement standards at the remote location, and re-set the local unit to change specific limitations or programmed variables. For example, to judge whether or not the measurement standards are correct, a means composed of the software and a comparator connected to a processor, and the variables can be changed if they are outside the predetermined scope.

Further, according to the present invention, a plurality of monitor standards are incorporated and the user can select them by means of different input and output cards. The input and output cards are connected to a sensor box, and the sensor box is attached to a specific part of the molding apparatus. These input and output cards process the signals from the sensors and generate signals that are received as input to the local unit.

The communication network is utilized between the local unit and the remote unit. Such a communication system can contain other protocols for receiving from and transmitting data to remote locations, such as telephone wires and Internet access. Alternatively, to transmit the data between them, other protocols that are well-known in this technical field, for example, LAN (Local Area Network) and WAN (Wide Area Network), are available.

A modem that is functionally connected to the local unit can be used as the means for accessing the communication network.

In the present invention, "at least at the stage of operation of the air-flow and press molding apparatus" means that it is possible to use it in response to the user command even at times other than when it is in operation. For example, it includes monitoring a log only when there is a warning in the specific required period, and recomposing the log of the data in response to the parameters.

"Monitoring the air-flow and press molding apparatus" means that the monitoring system for the air-flow and press molding apparatus outputs signals to a maintenance worker of the air-flow and press molding apparatus at the worksite via a facsimile machine, a cellular phone, or other mobile communication means, for example. Hereby, the need for maintenance can be transmitted to the worker as quickly as possible.

The remote unit is connected to the local unit via the communication network, and is adjusted to receive the signals from the local unit. Also, the remote unit is adjusted to indicate the measured attributes of the air-flow and press molding apparatus; thereby the air-flow and press molding apparatus can be monitored at a remote location at the stage of its production. In the same way as for the local unit, to determine whether or not the measurement standards are correct a function for analyzing the measured signal is provided.

BRIEF DESCRIPTIONS OF THE DRAWINGS

DESCRIPTIONS OF THE PREFERRED EMBODIMENTS

Hereinafter, an embodiment of the present invention will be explained with reference to the drawings.

Figure 1:
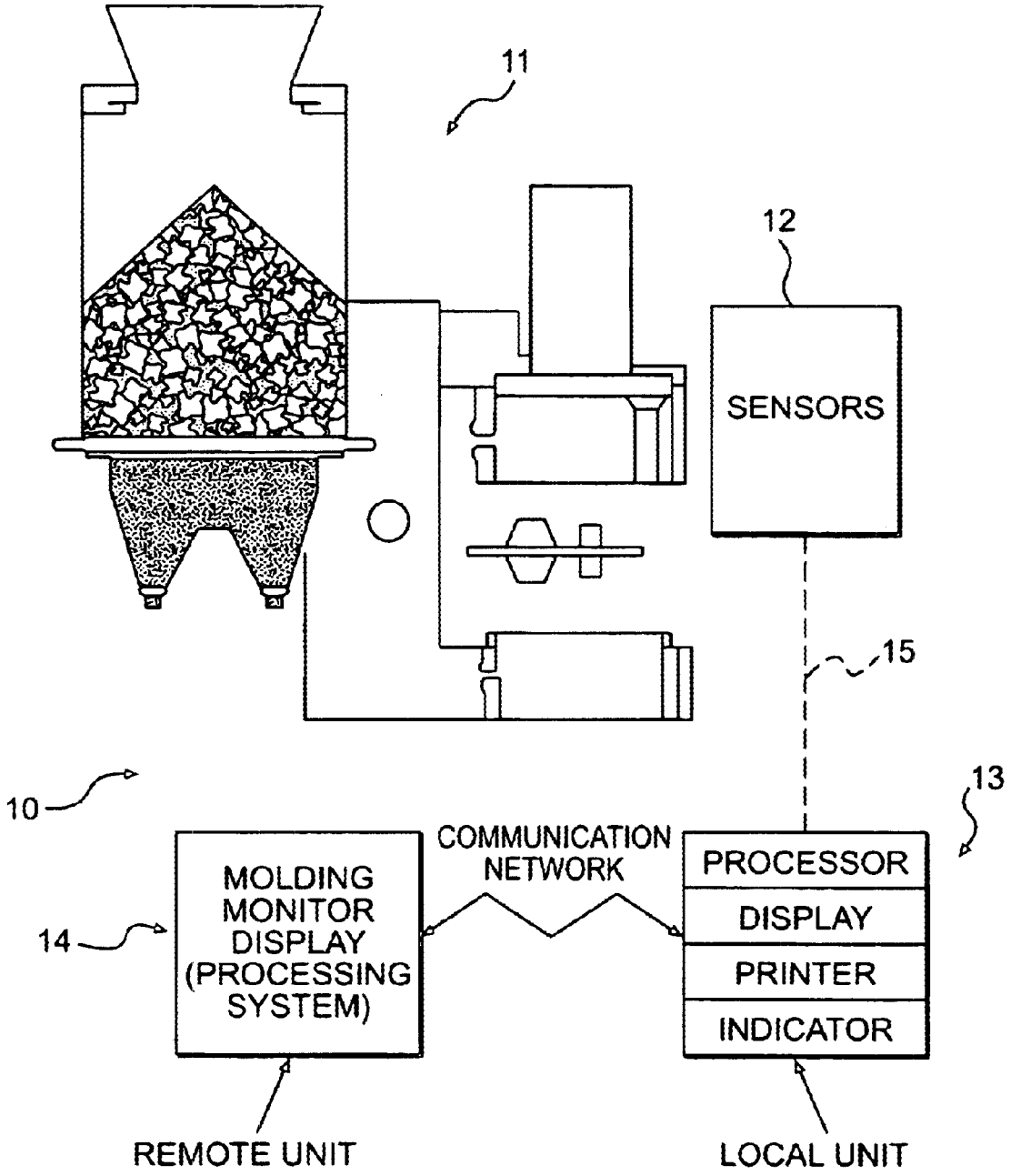
FIG. 1 is a conceptual diagram of a monitoring system for a molding apparatus 10 according to one embodiment of the present invention.

FIG. 1 is a schematic diagram of hardware configurations of a monitoring system for a molding apparatus 10 according to the first embodiment of the present invention. The monitoring system for the molding apparatus 10 of the present invention shown in FIG. 1 comprises sensors 12, a local unit 13, and a remote unit 14, as described below, and it is a system for monitoring a molding apparatus 11.

The sensors 12 comprise at least one sensor for monitoring required attributes about the molding apparatus 11, and are connected to the local unit 13 via a signal wire 15. The sensors 12 comprise a pressure sensor, a temperature sensor, a load sensor, an ammeter, a counter, a limit switch, a proximity switch, and so on. The sensors 12 transform a measured value into an electric signal, and output it to the signal wire 15. Then the signal wire 15 delivers the output signal from the sensors 12 to an input and output board (not shown) in the local unit 13.

The local unit 13 is a hardware system and comprises, but is not limited to, a processor, a display, a printer, an indicator, and so on. In the present invention the local unit 13 may be a personal computer. Also, the local unit 13 may be a plurality of programmable logic controllers (PLC) that comprise hardware or software, or many other types of electronic calculating processors. Also, the printer and indicator can be selected, and are not indispensable constituent features. The local unit 13 may be connected to a memory device (not shown), or comprise a memory means.

The input and output board can be made to have a configuration that comprises a signal processing system for transforming the output signals of the sensors 12, which are received via the signal wire 15, into a format convenient for processing (that includes transmitting, receiving and indicating) by the local unit 13. For example, if the sensors 12 are temperature sensors for measuring the sand temperature just above the molding apparatus 11, the input and output board may be a system for amplifying the weak analog signal that is output from the temperature sensor and transforming the amplified analog signal into a digital signal.

Moreover, the input and output board may be made into a multiplexer, in which case the input and output board transforms the voltage signals at the DC level that are received via the signal wire 15 into the numeric signals for processing on the local unit 13.

A means for accessing the communication network (not shown) in the present invention is a modem (not shown) that is functionally connected to the local unit 13, but other types of access means (a terminal adapter and router, for example) may be used, depending on the kind of communication network.

Here, as examples of the above-mentioned communication network, a dedicated telephone line, a dedicated communication line, a dial-up telephone line, a mobile radiophone system, a wireless network, an Internet access system, and other types of protocol for transmitting the data to a remote location are considered. In particular, in the case of the Internet access system, which has recently exploded in popularity, it is possible to monitor it inexpensively and clearly.

Also, the communication network may be the Local Area Network or a simple serial cable, or it may be a communication card that is computer-based to communicate with the communication network.

The remote unit 14, as shown in FIG. 1, is connected to the local unit 13 via the communication network. This remote unit 14 is designed so that it receives the output signal from the local unit 13 and indicates the attributes of the molding apparatus 11 that are measured by the sensors 12 based on the signal (data) on the monitor screen. Hereby, the user can monitor the molding apparatus 11 at the remote location at the stage of its production operation.

The remote unit 14 may also comprise an arbitrary type of indicator, such as a siren or a bell, denoting that the signals are received from the local unit 13, or it may be a personal computer in the present invention as well as the local unit 13. Further, the remote unit 14 may comprise a printer.

Moreover, the remote unit 14 can be a cellular phone, a Personal Handy Phone System (PHS), or a Personal Digital Assistant (PDA). In this case, the signals generated by the local unit 13 are indicated on the liquid crystal screen of the cellular phone in the form of an LED indicator. Hereby, the user can present to the service worker the signal data that is detected by the particular sensor and generated in the local unit 13 at an arbitrary remote location (anywhere the cellular phone can receive at least radio waves).

Figure 2:
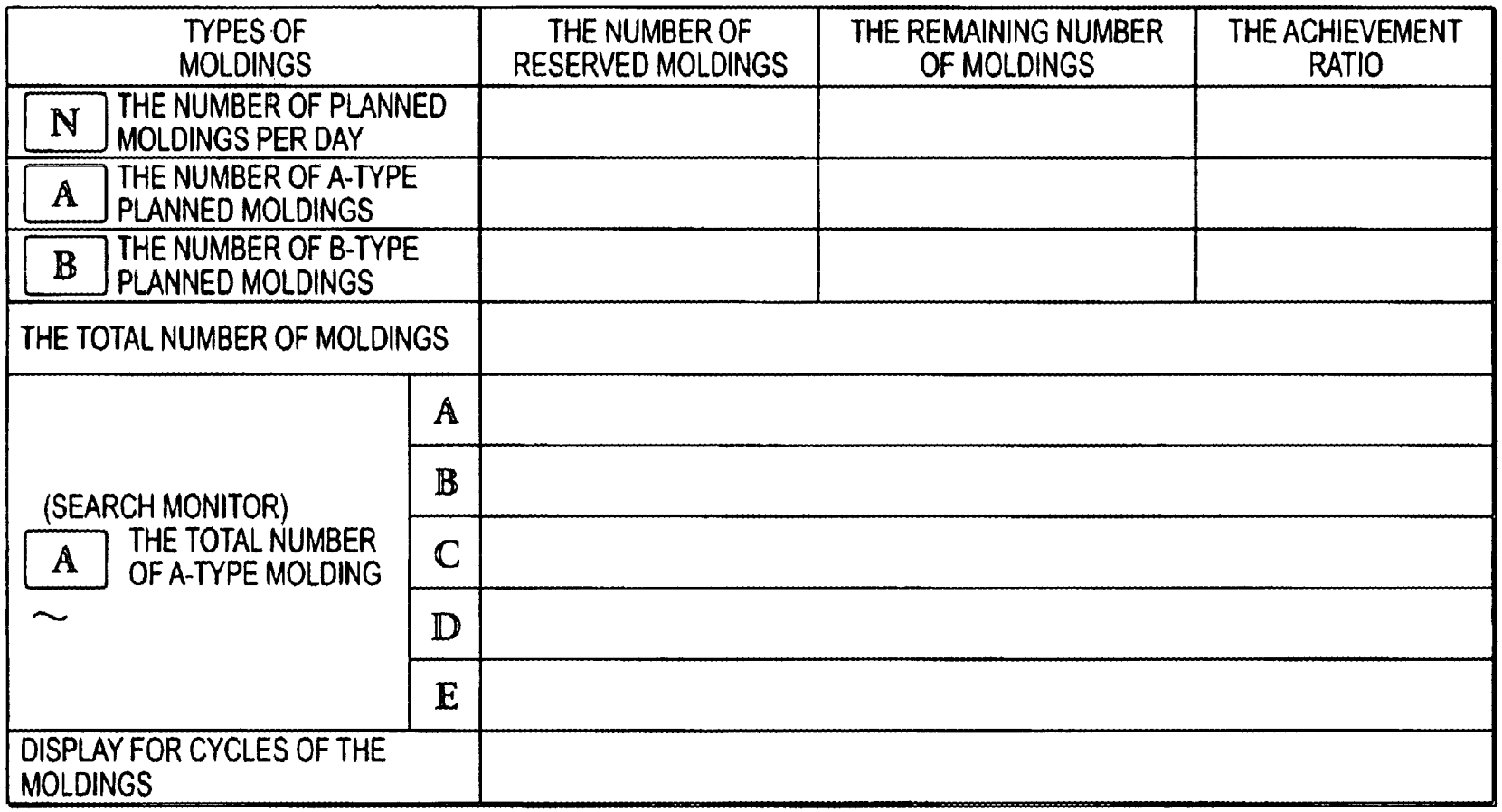
FIG. 2 shows one example of an indication of the monitor screen in the remote unit 14 according to one embodiment of the present invention.

FIG. 2 shows one example of an indication of the monitor screen of the function for monitoring the number of products in the remote unit 14 according to the first embodiment of the present invention. The monitoring system 10 according to the present invention comprises many monitoring functions, but in the embodiment it is discussed using the monitoring for the number of products, as one example. The function for monitoring the number of products is realized by a counter that counts the number of cycles of the molding apparatus 11 per day or per a particular number of hours. Using this counter, the monitoring system for the molding apparatus 10 also counts the number of planned moldings, the number of reserved moldings, the remaining number of moldings, the achievement ratio, the total number of moldings, the number of A-type planned moldings, and the number of B-type planned moldings, and indicates them on the display screen of the local unit 13 or the remote unit 14. In this case, as mentioned above, the signal that is transmitted from the particular sensor 12 is processed on the input and output board in the local unit 13, and then is indicated on the display screen.

As mentioned below, there are other monitored items, such as the molding pressure, air pressure, and motor load. The function for monitoring the molding data, for example, can monitor the following items.

The monitoring for the molding pressure is available to measure the squeeze pressure in molding, which is measured by the pressure gauge. The monitoring for air pressure is used to measure blow pressure, gas-flow pressure, and pressure from air shocks in molding, which are measured by the pressure gauge. The monitoring for motor load measures any change of the current of the motor of the molding apparatus in the case that the motor is utilized for the squeeze, which is measured by the ammeter.

The sand temperature is measured just above the molding apparatus by using the temperature sensor, and its temperature change is measured. Then the temperature sensor that has a DC output, for example, is connected to the multiplexer and thereby the output of the on-line sensor is transformed into a numeric signal. The transformed output signal is used for processing in the local unit 13.

For the selection of the programming language of the Operating System or various applications in the local unit 13 and the remote unit 14, the user can select properly according to the required functions of the entire monitoring system for the molding apparatus.

Further, because the operations of the local unit 13 may be carried out by software, it is possible to presently, or if necessary later, update the setting of the local unit 13 by a command or signal from the remote unit 14.

Moreover, the software developed to be used in the remote unit 14 has the function to analyze the measured signal that is transmitted via the communication network, so the user can easily judge the condition of the molding apparatus 11 based on the measured signal data.

As seen above, the present invention is a monitoring system for the molding apparatus. It comprises sensors for measuring required attributes associated with the molding apparatus; a local unit for transmitting signals that correspond to the required attributes measured with said sensor over a network; and a remote unit connected to said communication network for receiving the signals that correspond to the required attributes from said local unit, for indicating the required attributes associated with the molding apparatus, and for monitoring the molding apparatus at least at the stage of operation of the molding apparatus. Therefore, the contribution that can be made to the foundry industry is remarkably large, as it can provide a monitoring system for a molding apparatus that monitors the molding apparatus in production and transmits the data to a remote location.

Figure 3:
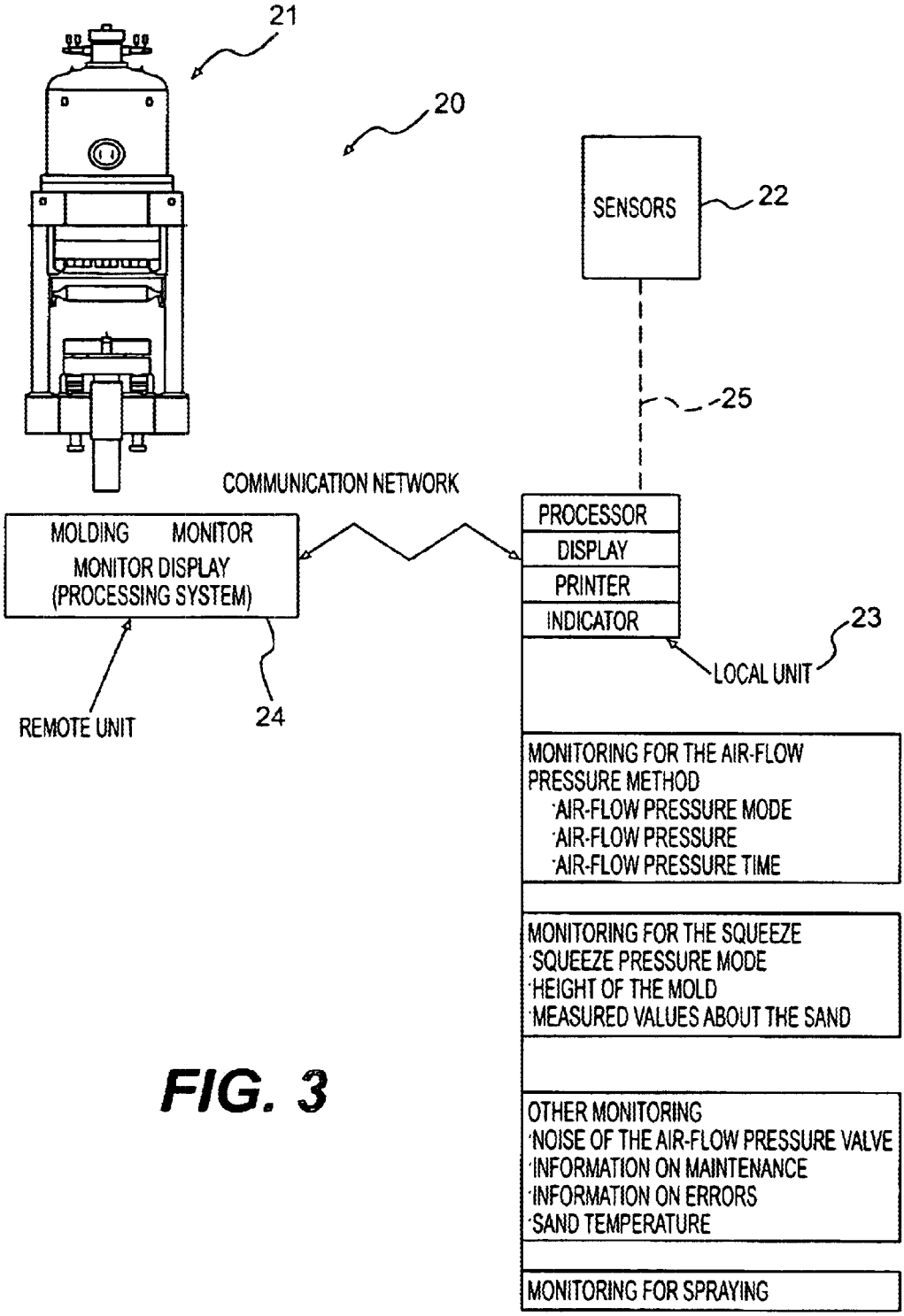
FIG. 3 is a conceptual diagram of a monitoring system for an air-flow and press molding apparatus 20 according to one embodiment of the present invention.

FIG. 3 schematically shows hardware configurations of a monitoring system for an air-flow and press molding apparatus 20 according to the second embodiment of the present invention. In this FIG. 3, the monitoring system for an air-flow and press molding apparatus 20 comprises sensors 22, a local unit 23, and a remote unit 24. The local unit 23 is connected to the sensors 22 that are mentioned below via a signal wire 25.

In the case of monitoring the attributes associated with the air-flow pressure, the sensors 22 include a pressure sensor, a timer, and a sensor for measuring the height, or an infrared-ray distance meter. In the case of monitoring the attributes associated with the squeeze, the sensors include a pressure gauge by which the squeeze pressure is measured, encoders by which the height of the molding and the features of the molding sand are measured, a moisture meter and a temperature sensor by which other features of the molding sand are monitored, or an image sensor by which changes in the pattern are monitored. Also, the sensors 22 are temperature sensors in the case of monitoring the sand temperature of the air-flow and press molding apparatus 21, and are a plurality of voltmeters to measure the voltages applied to sections of spray apparatuses in the case of monitoring the spray apparatuses, more than two of which are attached to a sealed frame of the air-flow and press molding apparatus. They are also sensors for measuring noise that are attached around the air-flow pressure tank in the case of monitoring the noise according to the air-flow and press molding apparatus.

When the sand temperatures just above the air-flow and press molding apparatus are measured by the temperature sensors, the sensors 22 are systems for amplifying weak analog signals and transforming the amplified analog signals into digital signals.

The signal wire 25 delivers the output signal from the sensors 22 to an input and output board (not shown) in the local unit 23. The input and output board can be made into a signal processing system for transforming the output signals of the sensors 22, which are received via the signal wire 25, into a format convenient for processing (that includes transmitting, receiving and indicating) by the local unit 23. Also, the input and output board may be made into a multiplexer; and, in this case, the input and output board transforms the voltage signals at the DC level that are received via the signal wire 25 into numeric signals for processing by the local unit 23.

The local unit 23 is a hardware system, and comprises but is not limited to a processor, a display, a printer, an indicator, and so on. In the present invention the local unit 23 may be a personal computer. Further, the local unit 23 may be connected to a memory device (not shown), or comprise a memory means; thereby the local unit 23 memorizes the numeric data from the sensors 22, such as a pressure gauge, etc., in the memory device.

In the present invention an access means for accessing the communication network (not shown) is a modem (not shown) that is functionally connected to the local unit 23. In the present invention the remote unit 24 may also comprise an arbitrary type of indicator, such as a siren or a bell, denoting that the signals are received from the local unit 23, or may be a personal computer.

The operation of the present invention that is composed as described above is explained below.

Figure 4:
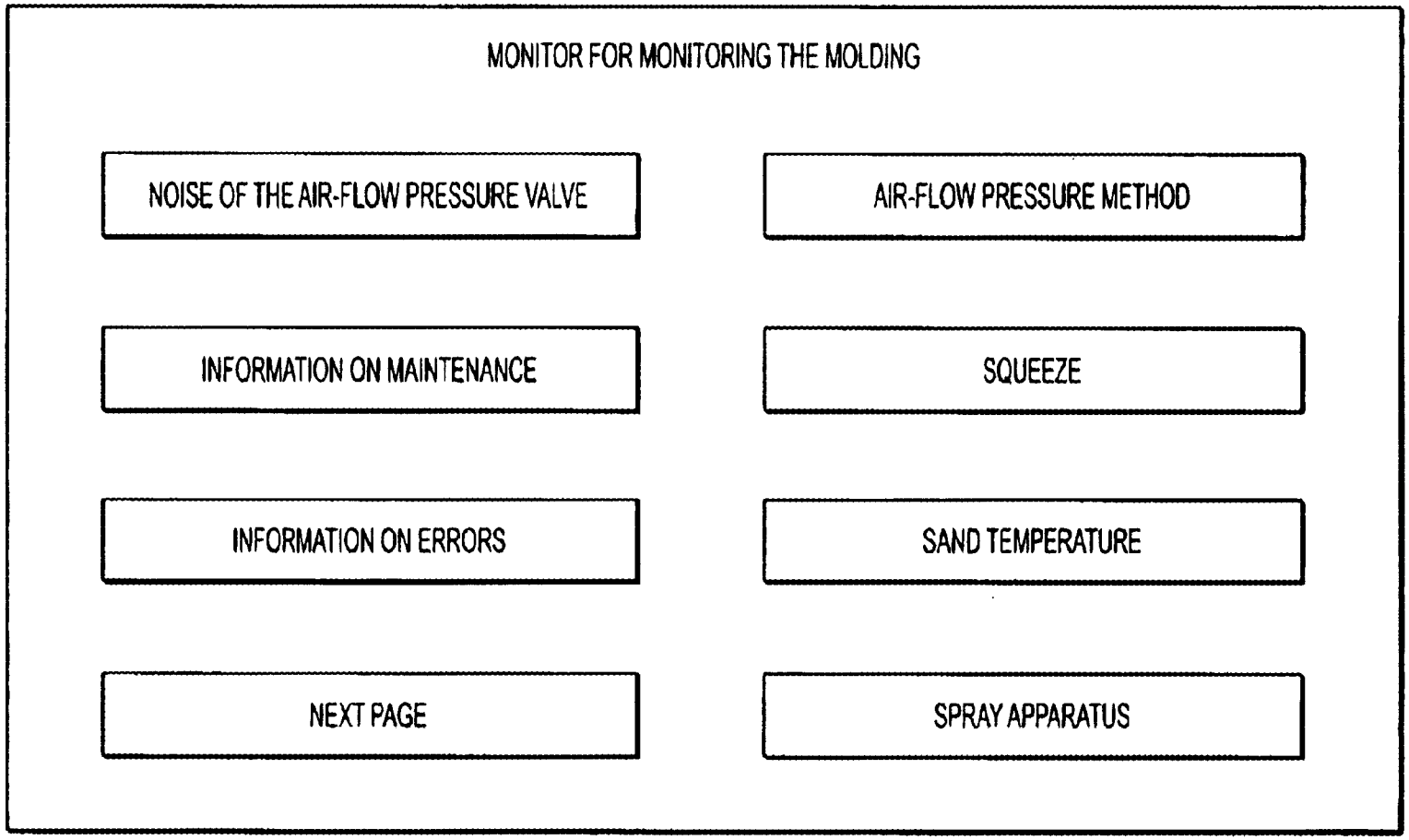
FIG. 4 is an example of an indication of the monitor screen, which represents a monitoring function of a method for molding according to one embodiment of the present invention.

FIG. 4 shows an example of an indication of the monitor screen, which represents a monitoring function of a method for molding according to the second embodiment of the present invention. The monitoring system for the air-flow and press molding apparatus 20 has many monitoring functions. One example is the case in which a monitoring function for the air-flow pressure method is selected. The sensor 22 is a pressure gauge in this case.

When the air-flow and press molding apparatus is operating, the air pressure, the air pressure in the air-flow pressure tank, and the air pressure in the air-flow pressure head are measured by the pressure gauge 22. Then the processor in the local unit 23 calculates these differential pressures by using an operating system, and determines whether the values are within the permissible zone. If the values are outside of the permissible zone, the processor sends a signal that warns of an error to the remote unit 24, and outputs to the air-flow and press molding apparatus 21 the order to automatically compensate (such as by opening or closing the air-flow pressure valve). The processor also makes the display screen of the local unit 23 indicate an air-flow pressure curve.

Further, because the remote unit 24, as shown in FIG. 3, is connected to the local unit 23 via the communication network, it receives the signals that are transmitted from the local unit 23 via the communication network and indicates the data on the display screen of the remote unit 24. Therefore, because the user can receive the data of the attributes which are measured by the sensors 22 of the air-flow and press molding apparatus 21 and indicate it, the user can monitor the condition of the air-flow pressure under the production of the mold of the air-flow and press molding apparatus 21.

In addition, the remote unit 24 may be a cellular phone as well as the first embodiment: in that case the signals generated by the local unit 23 are indicated on the liquid-crystal screen of the cellular phone. By this means, the user can present to the service representative the values that are read that are detected by the particular sensor.

Moreover, according to the present invention, because it accumulates daily data on information associated with regular or preventive maintenance of the air-flow and press molding apparatus in the memory device, it is possible to do better maintenance, so as to prevent excessive repairs or to prevent an eventual decline in production efficiency by continuing to produce until the product line is stopped because of some problem, for example.

Next, the case in which a monitoring function for the squeeze is selected is discussed. The monitoring system for the air-flow and press molding apparatus 20 can select the monitoring function for the squeeze in many monitoring functions, as illustrated in FIG. 4.

When the air-flow and press molding apparatus 21 is operating, the monitoring function for the squeeze (which the processor in the local unit 23 processes) determines whether various numeric values are within the permissible zone of the coefficient, which is determined from the value of the compactablity of molding sand, and the height of the mold. The values are measured by the encoders for measuring the height of the mold, and by the pressure gauge for measuring the squeeze pressure, which are located the above-mentioned sensors 22. In this case, the determination is processed by comparison operating the differential value between the numeric signal that is transmitted to the operating system in the local unit 23 and the height of the mold that is pre-memorized in the memory device (not shown). If the differential value is within the permissible zone, it determines that the air-flow and press molding apparatus 21 works normally. If it is outside of the zone, it sends a warning to the user and outputs the order of the change of the molding condition. The system 20 also indicates the measured value on the display screen of the local unit 23.

Since the remote unit 24 is connected to the local unit 23 via the communication network, it receives the signals that are transmitted to the local unit 23, and indicates on the display screen of the remote unit 24 the attribute data of the air-flow and press molding apparatus 21, which is measured by the sensors 22. Thereby, the user can monitor the condition of the squeeze under the production of the air-flow and press molding apparatus 21 at the remote location.

Next, the case in which a monitoring function for the sand temperature is selected is discussed. The monitoring system for the air-flow and press molding apparatus 20 can select the monitoring function for the sand temperature in many monitoring functions, as illustrated in FIG. 4.

When the air-flow and press molding apparatus 21 is operating, the monitoring function for the sand temperature (which the processor in the local unit 23 processes) makes the temperature sensors (the sensors 22), by which the temperature of the molding sand is measured just on the air-flow and press molding apparatus, measure the sand temperature, and makes the display screen of the local unit 23 indicate the measured value.

Since the remote unit 24 is connected to the local unit 23 via the communication network, it receives the signals that are transmitted to the local unit 23, and indicates the attribute data of the air-flow and press molding apparatus 21, which is measured by the sensors 22, on the display screen of the remote unit 24. Thereby, the user can monitor the sand condition under the production of the air-flow and press molding apparatus 21 at the remote location.

Next, the case in which a monitoring function for the spray apparatus is selected will be discussed. The monitoring system for the air-flow and press molding apparatus 20 can select the monitoring function for the spray apparatus in many monitoring functions, as illustrated in FIG. 4.

In the monitoring spray apparatus, since the user knows the condition of the spray operation through each voltmeter of the spray apparatus when the air-flow and press molding apparatus 21 is operating, the user can change the operation of the spray apparatus to any condition necessary. The operating system in the local unit 23 memorizes the method for controlling the operation and the number of sprays of this spray apparatus in every pattern in advance. It determines by comparing the value with the measured result, outputs the proper order to the spray apparatus, and makes the display screen of the local unit 23 indicate the condition of the spraying of the mold parting agent. It is also possible to monitor from a remote location by the remote unit 24 as well as by the above-mentioned embodiment.

According to this embodiment, since the user can monitor the condition of the spraying of the mold parting agent, the user can take any necessary countermeasure for securing the quality of the mold products through a correlative analysis with any defect in the pattern of molding caused by the lack of a mold parting agent.

Next, the case in which a monitoring function for the noise of the air-flow pressure valve is selected will be mentioned. The monitoring system for the air-flow and press molding apparatus 20 can select the monitoring function for the noise of the air-flow pressure valve in many monitoring functions, as illustrated in FIG. 4.

The monitoring function for the noise of the air-flow pressure valve (which the processor in the local unit 23 processes) determines whether a noise value and a frequency analysis value are within the permissible zone by using an operating system. If the value is outside of the permissible zone, the processor warns the user of an error, and outputs to the air-flow and press molding apparatus 21 an order to process the error. The monitoring system for the air-flow and press molding apparatus 20 can also indicate the noise value and the frequency analysis value on the display screen of the local unit.

According to this embodiment, since the error is detected and a warning given based on the increase of the high frequencies due to the frequency analysis, for example, the user can carry out preventive maintenance of the air-flow and press molding apparatus 21 if necessary. Further, the user can properly determine the time of maintenance based on the noise value and the frequency analysis value.

Next, the case in which any of the above-mentioned sensors can be selectable is discussed. In FIG. 3 the local unit 23 is composed such that it can be connected to the above-mentioned sensors selectively. Therefore, as shown in FIG. 4, the monitoring system for the air-flow and press molding apparatus 20 can monitor the monitoring for the air-flow pressure, the monitoring for the squeeze, the monitoring for the sand temperature, the monitoring for the air-flow pressure valve to determine any error in the noise of the air-flow pressure valve, the monitoring for spraying the mold parting agent, and information on maintenance and errors that is acquired by integrating this information.

Further, the operating system to analyze all the functions mentioned above may be contained in the remote unit 24. In this case, since the user can analyze the measured signals that are transmitted via the communication network at the remote location by the remote unit 24, the user can make decisions in relation to the molding condition and operating condition of the air-flow and press molding apparatus 21 even if at a remote location.

As seen above, a monitoring system for the air-flow and press molding apparatus according to the present invention comprises sensors for measuring required attributes associated with the air-flow and press molding apparatus; a local unit for transmitting signals that correspond to the required attributes measured with said sensors over a network; and a remote unit connected to said communication network for receiving the signals transmitted from the local unit, for indicating the required attributes associated with the air-flow and press molding apparatus, and for monitoring the molding apparatus in the event of at least an operation of the air-flow and press molding apparatus. Thereby, the potential contribution to the foundry industry is remarkably large, as it can provide a monitoring system for the molding apparatus that monitors the molding apparatus in production and transmits the data to a remote location.

What is claimed is:

1. A monitoring system for an air-flow and press molding apparatus comprising:

sensors for measuring the required attributes associated with air-flow pressure of the air-flow and press molding apparatus;

a local unit for transmitting signals that correspond to the required attributes measured with said sensors over a communication network; and a remote unit connected to said communication network for receiving the signals transmitted from the local unit, indicating the required attributes associated with the air-flow and press molding apparatus, and monitoring the molding apparatus at least at the stage of operation of the air-flow and press molding apparatus.

2. The monitoring system for an air-flow and press molding apparatus according to claim 1, wherein the attributes of said air-flow and press molding apparatus include at least one method of spraying a mold parting agent and data on a measured sound noise of an air-flow pressure valve.

3. The monitoring system for an air-flow and press molding apparatus according to claim 1, wherein said local unit comprises a means for determining whether the signals that are measured by said sensors are within predetermined zones, and a system accessing a communication network and transmitting a warning signal to said remote unit if the signals are outside of the predetermined zones.

4. The monitoring system for an air-flow and press molding apparatus according to claim 3, wherein the attributes of said air-flow and press molding apparatus include at least one method of spraying a mold parting agent and data on a measured sound noise of an air-flow pressure valve.

5. The monitoring system for an air-flow and press molding apparatus according to claim 3, wherein the remote unit is designed to communicate with said local unit via the communication network and to change the predetermined zones associated with said judging means.

6. The monitoring system for an air-flow and press molding apparatus according to claim 5, wherein the attributes of said air-flow and press molding apparatus include at least one method of spraying a mold parting agent and data on a measured sound noise of the air-flow pressure valve.

7. A monitoring system for an air-flow and press molding apparatus comprising:

sensors for measuring the required attributes associated with squeeze of the air-flow and press molding apparatus;

a local unit for transmitting signals that correspond to the required attributes measured with said sensors over a communication network; and a remote unit connected to said communication network for receiving the signals transmitted from the local unit, indicating the required attributes associated with the air-flow and press molding apparatus, and monitoring the molding apparatus at least at the stage of operation of the air-flow and press molding apparatus.

8. The monitoring system for an air-flow and press molding apparatus according to claim 7, wherein the attributes of said air-flow and press molding apparatus include at least one method of spraying a mold parting agent and data on a measured sound noise of an air-flow pressure valve.

9. The monitoring system for an air-flow and press molding apparatus according to claim 7, wherein said local unit comprises a means for determining whether the signals that are measured by said sensors are within predetermined zones, and a system accessing a communication network and transmitting a warning signal to said remote unit in the case that the signals are outside of the predetermined zones.

10. The monitoring system for an air-flow and press molding apparatus according to claim 9, wherein the attributes of said air-flow and press molding apparatus include at least one method of spraying a mold parting agent and data on a measured sound noise of an air-flow pressure valve.

11. The monitoring system for an air-flow and press molding apparatus according to claim 9, wherein the remote unit is designed to communicate with said local unit via the communication network and to change the predetermined zones associated with said determining means.

12. The monitoring system for an air-flow and press molding apparatus according to claim 11, wherein the attributes of said air-flow and press molding apparatus include at least one method of spraying a mold parting agent and data on a measured sound noise of an air-flow pressure valve.

* * * * *